United States Patent [19]

Edholm et al.

[11] Patent Number: 4,687,105

[45] Date of Patent: Aug. 18, 1987

[54] ARRANGEMENT IN GRADING AND CLEANING MACHINES WITH SCREENS

[75] Inventors: Thomas Edholm, Staffanstorp; Ulf Ståhl, Höllviksnäs, both of Sweden

[73] Assignee: Kamas Industri AB, Vellinge, Sweden

[21] Appl. No.: 786,228

[22] Filed: Oct. 9, 1985

Related U.S. Application Data

[63] Continuation of Ser. No. 685,598, Dec. 26, 1984, abandoned, which is a continuation of Ser. No. 470,534, Feb. 28, 1983, abandoned.

[30] Foreign Application Priority Data

Mar. 3, 1982 [SE] Sweden ..... 8201295

[51] Int. Cl.[4] ..... B07B 1/42

[52] U.S. Cl. ..... 209/546; 73/861.73; 209/1; 209/233; 364/555

[58] Field of Search ..... 209/1, 44.1, 509, 546, 209/549, 552, 600, 680, 233, 235, 242, 243, 245–247, 315, 398, 363, 237; 73/861.41, 861.73; 324/71.4; 340/606, 609–611, 673; 364/502, 478, 479, 555; 222/56, 59, 63

[56] References Cited

U.S. PATENT DOCUMENTS

| | | | |
|---|---|---|---|
| 3,154,824 | 11/1964 | Dietert | 209/243 |
| 3,606,745 | 9/1971 | Girodat | 209/1 |
| 4,063,456 | 12/1977 | Jonkers | 73/861.73 |
| 4,318,806 | 3/1982 | Satake | 209/496 |

FOREIGN PATENT DOCUMENTS

| | | | |
|---|---|---|---|
| 532177 | 10/1956 | Canada . | |
| 967916 | 5/1975 | Canada . | |
| 2140782 | 1/1973 | France . | |
| 2437653 | 4/1980 | France . | |
| 2457719 | 12/1980 | France . | |
| 1137777 | 9/1966 | United Kingdom . | |
| 1384882 | 2/1975 | United Kingdom | 73/861.73 |
| 2042935 | 10/1980 | United Kingdom . | |
| 2067925 | 8/1981 | United Kingdom . | |
| 580015 | 11/1974 | U.S.S.R. | 209/133 |
| 707619 | 8/1976 | U.S.S.R. . | |
| 759150 | 5/1978 | U.S.S.R. . | |
| 740303 | 9/1978 | U.S.S.R. . | |
| 899130 | 1/1982 | U.S.S.R. | 209/233 |

*Primary Examiner*—Robert B. Reeves
*Assistant Examiner*—Donald T. Hajec
*Attorney, Agent, or Firm*—Merchant, Gould, Smith, Edell, Welter & Schmidt

[57] ABSTRACT

An arrangement in grading and cleaning machines with a screen (15). The screen is associated with at least one sensor (24) in the flow of material passing through the screen for generating electric signals in dependence on material particles leaving the screen as throughput and impinging on the sensor. The sensor is operatively connected to be adjusted (26) through a function circuit (25) for the control of various operations parameters of the screen (15) in dependence on the impingement intensity to achieve a throughput according to a predetermined mathematical model.

6 Claims, 4 Drawing Figures

ARRANGEMENT IN GRADING AND CLEANING MACHINES WITH SCREENS

Figure 1:
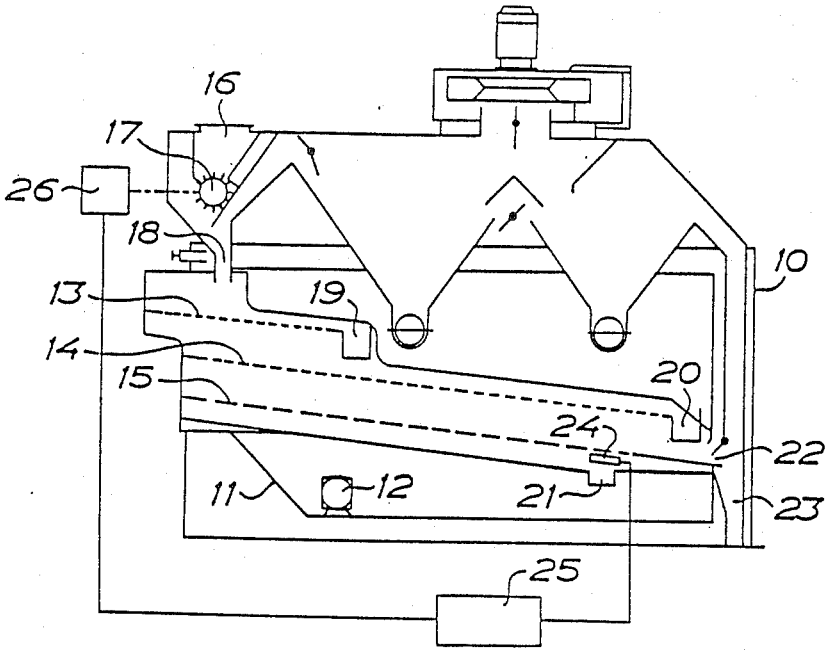

This is a continuation of application Ser. No. 685,598, filed Dec. 26, 1984, which is a continuation of Ser. No. 470,534, filed Feb. 28, 1983, both abandoned.

The invention relates to grading and cleaning machines with a screen, such as e.g. grading and cleaning machines for grading and/or cleaning grain, seeds and similar materials, wherein one or more shaking screens are provided for grading the material according to different particle sizes and for separating impurities and other admixtures which are not desired, such as small kernels and kernel parts. However, the invention is not limited to this specific use; it can be applied also in machines of other types for grading or cleaning other materials.

It is important to utilize optimally the capacity of machines of the type referred to above, which means that the flow over the screen at each time should be as large as possible without the separation being reduced to such an extent that the scalp-overs contain a too large or too small portion of particles that should be separated on the screen and should leave the screen as throughput. Since it is desired to utilize the full capacity of the machine, it may be rather tempting to feed into the machine a flow which is larger than the flow which could be received by the machine at an acceptable efficiency. Then, the quality of the scalp-overs may be impaired if the scalp-overs constitute the good product, because such material as normally had passed through the screen as throughput instead will be carried along by the scalp-overs as an impurity therein due to accumulation of material on the screen. Alternatively, the loss of good product can be considerable if the throughput constitutes the good product, because a considerable portion of the material to be recovered as good product has no time to pass through the screen but will be discharged together with the less valuable scalp-overs. E.g. in machines for grading and cleaning grain wherein a fine screen is provided and serves the purpose of separating from the supplied material to be cleaned, impurities and other admixtures not desired such as small kernels and kernel parts, passing through the screen as throughput while the good product leaves the screen as scalp-overs, said problem can arise and manifest itself as a too high content of impurities in the form of small kernels and kernel parts in the good product if the flow of material to be cleaned, which is supplied to the machine, is too large.

The object of the invention is to provide in machines of the type referred to above an arrangement by which the screen efficiency is automatically affected and controlled in relation to the cleaning and/or grading result aimed at.

In order to achieve said object there is provided according to the invention an arrangement in grading and cleaning machines with a screen, wherein the screen is associated with at least one sensor in the flow of material passing through the screen, for generating electric signals in dependence on material particles leaving the screen as throughput and impinging on the sensor, and the sensor through a function circuit is operatively connected to adjusting means for controlling an operational parameter of the screen in dependence on the impingement intensity.

Figure 2:
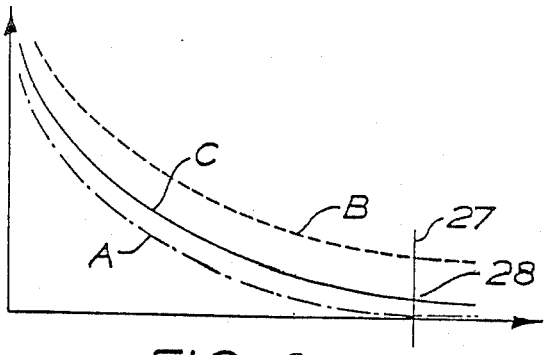
Figure 3:
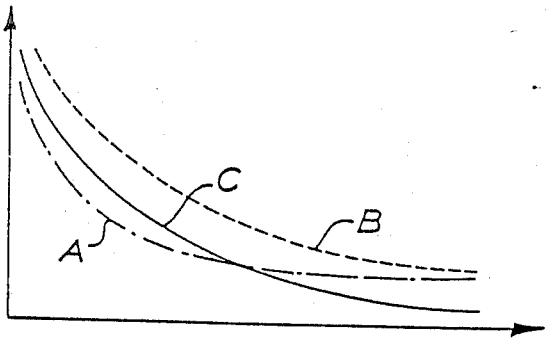
Figure 4:
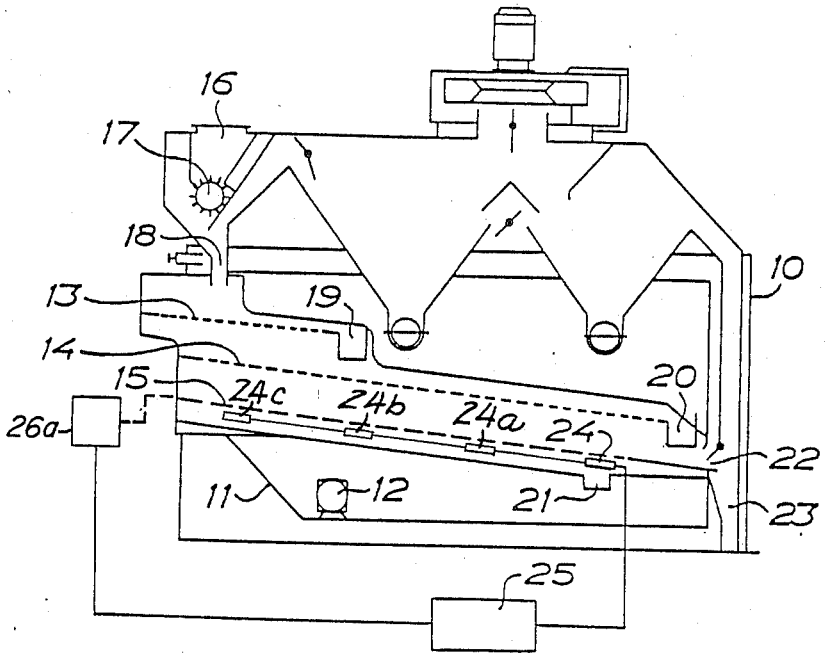

The invention will be described in more detail below, reference being made to the accompanying drawing in which FIG. 1 is a diagrammatic vertical sectional view of an embodiment of a cleaning and grading machine arranged in accordance with the invention, FIGS. 2 and 3 are graphs showing the distribution of the throughput over the length of the shaking screen, FIG. 4 is a diagrammatical vertical sectional view like FIG. 1 except indicating an alternate embodiment.

The machine proper is of an embodiment previously known per se. It includes a machine frame 10 with a screen shoe 11 elastically suspended therein, which is driven by means of a shaking motor 12. In the screen shoe there are arranged from top to bottom a scalper screen 13, a sorting screen 14, and a fine screen 15. For the supply of the material to be screened there is provided above the scalper screen an inlet funnel 16 having a feed roll 17 e.g. with a variator, for the supply of the material to be screened to the screens through a rising sifter 18. For the removal of the scalp-overs from the scalper screen 13 and the sorting screen 14 discharge chutes 19 and 20, respectively, are provided, and for material passing through the fine screen, i.e. impurities and other admixtures not desired such as small kernels and kernel parts, a discharge chute 21 is provided. The scalp-overs from the fine screen constitute the good product, and for this product an outlet 22 controlled by a throttle is provided which opens into a rising sifter 23. Means for generating the air streams in the rising sifters 18 and 23 are shown in the drawing but need not be described in more detail in connection with the invention.

The arrangement according to the invention is applied to the fine screen 15 and comprises a sensor 24 located below the fine screen in the region of the outlet end thereof. This sensor can comprise e.g. a crystal microphone, a differential transformer or a dynamic pick-up. Any other type of sensor can be used; it is important, however, that the sensor generates an electric signal when particles are impinging on the sensor. The signal from the sensor 24 is supplied to an electronic function circuit 25 (micro-processor), wherein the signal will be amplified. In dependence on the number of hits registered by the sensor 24 per time unit, a signal is generated in the function circuit 25. Said signal is supplied to adjusting means 26 for the variator of the feed roll 17 for adjustment of the speed of the feed roll to such value that the number of hits against the sensor 24 is below a maximum value preset in the function circuit 25 but at the same time also exceeds a minimum value preset in said circuit. The adjustment can also take place in dependence on the time measured between two hits following one after the other, which are registered by the sensor.

Referring to the graph in FIG. 2, a flow of material to be screened which is supplied to the fine screen 15 and is at or below the capacity of the screen, will give a throughput which decreases progressively along the length of the screen according to the dot and dash line curve A. However, if more material to be screened is supplied than should be received by the screen, the throughput will follow the dash line curve B, which means that the amount of throughput is considerable also at the outlet end of the screen. Therefore, it may be expected that there is still in the scalp-overs a proportion of the material that should pass through the screen but has not been able to do that due to accumulation of material on the screen or for other reasons, e.g. packing.

However, optimal conditions should prevail if the throughput followed the solid line curve C and thus it is the task of the function circuit to set the speed of the feed roll 17 at such value that this curve will be followed. If it is assumed that the sensor 24 is located at the position marked by the line 27, the function circuit accordingly should be adjusted in such a way that the limit values thereof correspond to predetermined maximum and minimum parameters, that is, one to a point somewhat over and the other to a point somewhat below the point 28, or one limit value may correspond to the point 28 and the other to a point somewhat over or somewhat below the point 28.

The limit values of the function circuit should be adjustable and the adjustment thereof has to be made empirically in dependence on the material to be screened and the purity of the material to be screened, because different types of material generate different numbers of hits on the sensor when the throughput is on the curve corresponding to acceptable purity of the scalp-overs.

Since the throughput is changed with some delay after adjustment of the rotational speed of the feed roll, the function circuit 25 can be constructed to supply control pulses to the adjustment means 26 at intervals corresponding to the delay.

The operation described with reference to the curves in FIG. 2 is based on theoretical considerations. In practice, the curve A may have another form e.g. as shown in FIG. 3. In that case several sensors 24 can be distributed below the screen in the longitudinal direction thereof, the signals received by the function circuit 25 from said sensors being compared with a mathematic model representing the curve C, so as to generate an adjustment signal to the adjusting means 26, the conditions represented by the curve C being obtained thereby. The mathematical model, which represents curve C, also establishes predetermined maximum and minimum parameters for the acceptable range. In that case, also other operational parameters such as the inclination of the shaking screen, the shaking frequency or the stroke, the size of the screen openings of the shaking screen or other control measures affecting the efficiency of the screen, may be changed, which is true particularly in those cases when the curves A and B have a more complicated irregular form. In this way the throughput is fully controlled.

FIG. 4 illustrates schematically adjustment of an operational parameter such as shaking of the screen or adjustment of screen inclination by adjustment means 26*a*. The figure also illustrates a plurality of sensors 24, 24*a*, 24*b* and 24*c* across the length of the screen.

The function circuit (micro-processor) 25 has not been described in more detail, because the average man skilled in the art of electronics at the present state of the art would be able to design suitable circuits and circuit components for the achievement of the function described in detail above.

The invention has been described with reference to a specific grading and cleaning machine, but it can of course be applied to machines of another type. Thus, the invention can be applied not only to flat screens as in the embodiment described but also to drum screens.

We claim:

1. In a grading and cleaning machine with a screen and an input means for providing an adjustable input flow of material to the screen, the arrangement comprising a plurality of sensors arranged below the screen and distributed therealong to measure the flow of material passing through the screen at points along its surface, and a response circuit for generating electric signals in response to particles impinging on the sensors, said response circuit including means for sensing the number of particles impinging on each sensor and for adjusting the throughput of the machine by automatically comparing the impingement on each sensor to a predetermined mathematical model having predetermined maximum and minimum parameters and regulating said input means, to maintain the throughput within said parameters at all points along the screen where sensors are located.

2. A machine according to claim 1 wherein said mathematical model includes predetermined minimum and maximum throughput values which each decrease from one end of the screen most adjacent a source of the flow of material to the other end most distant from said source.

3. In a grading and cleaning machine with a screen and an input means for providing an adjustable input flow of material to the screen, and means for adjusting the angle of inclination of the screen, the arrangement comprising a plurality of sensors arranged below the screen and distributed therealong to measure the flow of material passing through the screen at points along its surface, and a response circuit for generating electric signals in response to particles impinging on the sensors, said response circuit including means for sensing the number of particles impinging on each sensor and for adjusting the throughput of the machine by automatically comparing the impingement on each sensor to a predetermined mathematical model having predetermined maximum and minimum parameters and regulating said adjusting means, to maintain the throughput within said parameters at all points along the screen where sensors are located.

4. A machine according to claim 3 wherein said mathematical model includes predetermined minimum and maximum throughput values which each decrease from one end of the screen most adjacent a source of the flow of material to the other end most distant from said source.

5. In a grading and cleaning machine with a screen and an input means for providing an adjustable input flow of material to the screen, shaking means for shaking said screen, and means for adjusting the frequency of said shaking means, the arrangement comprising a plurality of sensors arranged below the screen and distributed therealong to measure the flow of material passing through the screen at points along its surface, and a response circuit for generating electric signals in response to particles impinging on the sensors, said response circuit including means for sensing the number of particles impinging on each sensor and for adjusting the throughput of the machine by automatically comparing the impingement on each sensor to a predetermined mathematical model having predetermined maximum and minimum parameters and regulating said adjusting means, to maintain the throughput within said parameters at all points along the screen where sensors are located.

6. A machine according to claim 5 wherein said mathematical model includes predetermined minimum and maximum throughput values which each decrease from one end of the screen most adjacent a source of the flow of material to the other end most distant from said source.

* * * * *